US008408138B2

(12) United States Patent
Schwenzer et al.

(10) Patent No.: US 8,408,138 B2
(45) Date of Patent: Apr. 2, 2013

(54) LINER

(75) Inventors: Michael Schwenzer, Hermannsburg (DE); Ole Dau, Reppenstedt (DE)

(73) Assignee: Rheinmetall Waffe Munition GmbH, Ratingen (DE)

( * ) Notice: Subject to any disclaimer, the term of this patent is extended or adjusted under 35 U.S.C. 154(b) by 0 days.

(21) Appl. No.: 12/375,122

(22) PCT Filed: Jul. 6, 2007

(86) PCT No.: PCT/EP2007/005988

§ 371 (c)(1),
(2), (4) Date: Jan. 26, 2009

(87) PCT Pub. No.: WO2008/011969

PCT Pub. Date: Jan. 31, 2008

(65) Prior Publication Data

US 2010/0005996 A1 Jan. 14, 2010

(30) Foreign Application Priority Data

Jul. 25, 2006 (DE) ..... 10 2006 034 891

(51) Int. Cl.
*F42B 30/08* (2006.01)

(52) U.S. Cl. ..... 102/473; 102/293

(58) Field of Classification Search ..... 102/473, 102/489, 499, 289, 293; 86/51
See application file for complete search history.

(56) References Cited

U.S. PATENT DOCUMENTS

| | | | | | |
|---|---|---|---|---|---|
| 2,364,643 | A | * | 12/1944 | Moore et al. | 102/499 |
| 2,373,883 | A | * | 4/1945 | Ferrel | 102/499 |
| 3,491,694 | A | * | 1/1970 | Fountain | 102/493 |
| 3,943,208 | A | * | 3/1976 | Ratte et al. | 264/3.2 |
| 4,167,140 | A | * | 9/1979 | Biserod | 102/505 |
| 4,305,333 | A | * | 12/1981 | Altenau et al. | 102/493 |
| 4,337,218 | A | * | 6/1982 | Byrd et al. | 264/3.1 |
| 4,590,860 | A | * | 5/1986 | Kromrey | 102/289 |
| 4,649,823 | A | * | 3/1987 | Bell | 102/289 |
| 5,690,867 | A | | 11/1997 | Nouguez | |
| 5,939,662 | A | * | 8/1999 | Bootes et al. | 102/499 |
| 6,860,185 | B2 | * | 3/2005 | Altenau | 86/51 |
| 2004/0031380 | A1 | | 2/2004 | Altenau | |

FOREIGN PATENT DOCUMENTS

| | | |
|---|---|---|
| EP | 0774643 | 5/1997 |
| EP | 1338860 | 8/2003 |
| EP | 1376047 | 1/2004 |

* cited by examiner

*Primary Examiner* — Jonathan C Weber
(74) *Attorney, Agent, or Firm* — Lucas & Mercanti, LLP; Klaus P. Stoffel

(57) ABSTRACT

In order to prevent slipping of the liner on an explosive charge in a missile, the invention provides that at least one flaring or cam is fixed in the liner which, when deformed inwards, can hook itself on the explosive charge.

1 Claim, 3 Drawing Sheets

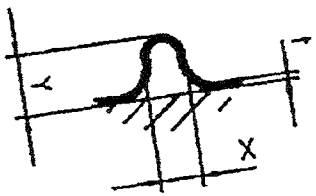
FIG..1a
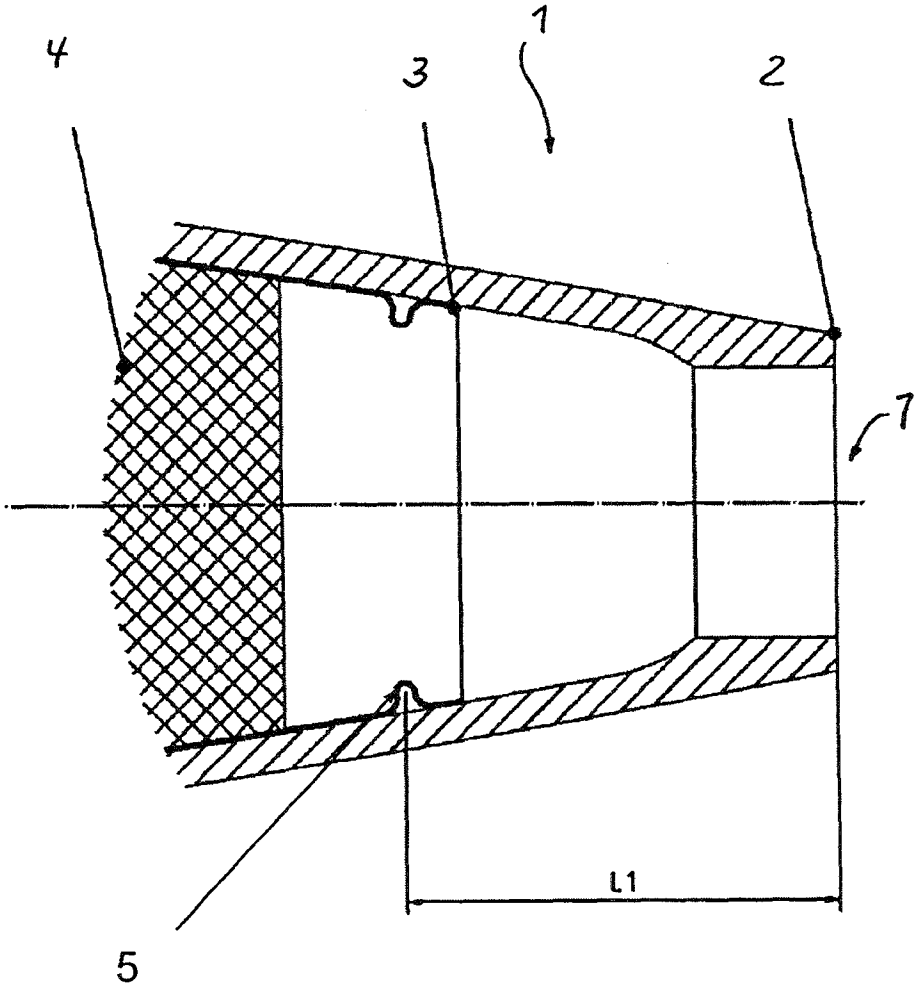
FIG..1

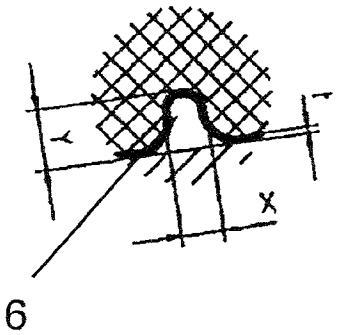
FIG..2a
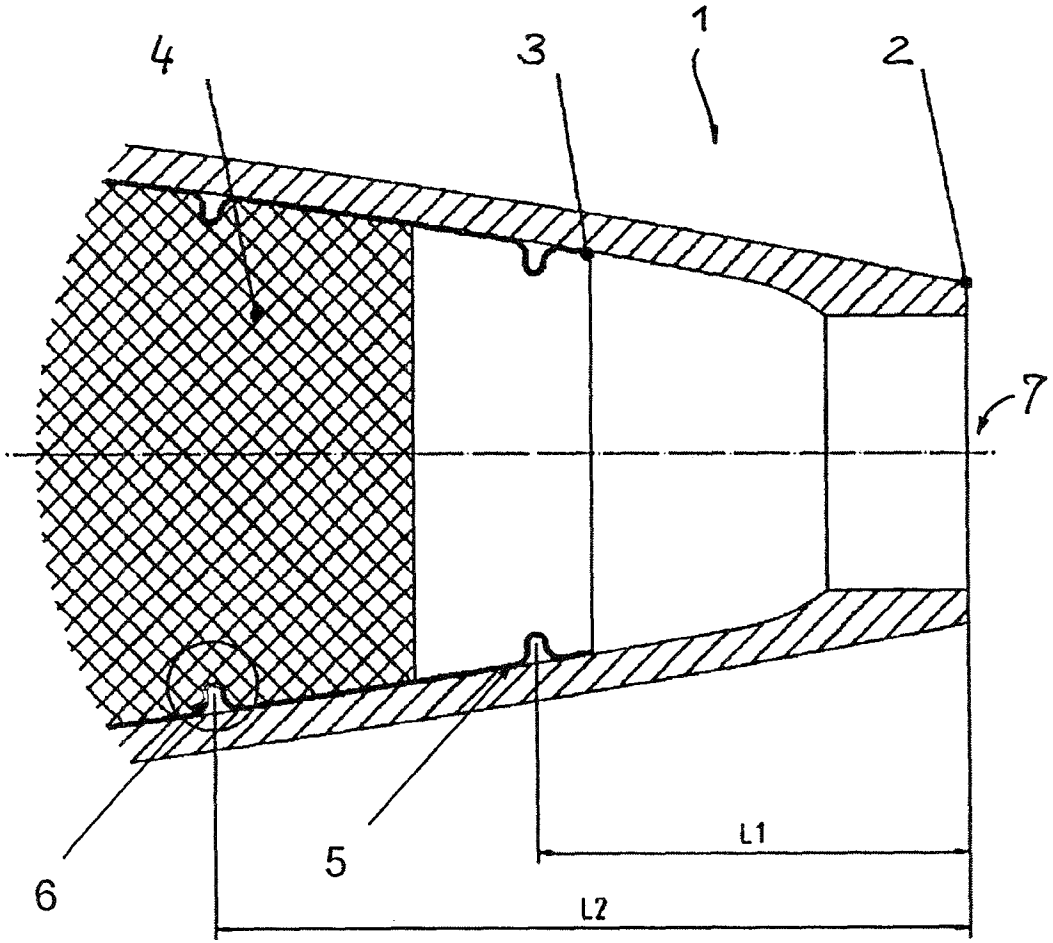
FIG..2

LINER

BACKGROUND OF THE INVENTION

In insensitive artillery munitions, there is no direct contact between the insensitive high explosive (IHE) and the wall of the projectile in order to prevent the development of thermal stresses due to the different coefficients of thermal expansion of the IHE and the projectile casing. Therefore, a liner, usually a plastic bag, is placed between the two in the projectile casing. The IHE is then cast and cured.

EP 1 338 860 B1 discloses a large-caliber high-explosive projectile and a method for producing it. This document proposes a liner in the form of a plastic casing made of an elastic material, so that the changing volume of the high-explosive charge that occurs during temperature fluctuations is absorbed by the elastic plastic casing. The liner, in the form of a structure that is folded together or pressed together, is inserted through a fuse hole, which normally serves to hold the nose fuse. In its unfolded state, this bag-shaped plastic casing conforms to the dimensions of the interior of the high-explosive projectile.

In some cases, the liner is not stiff enough to be able to compensate its own thermal expansion in line with the expansion of the high-explosive charge. Due to its great thermal expansion, the high-explosive charge contracts and expands by several mm during cooling and heating, respectively. The liner contracts with the high-explosive charge but does not expand with it to the same extent. This causes a displacement of the liner on the high-explosive charge. Over many changes in temperature, the liner shifts to the rear relative to the high-explosive charge, so that the charge can become partially exposed.

SUMMARY OF THE INVENTION

The object of the invention is to prevent a liner from being displaced on the high-explosive charge.

The invention is based on the idea of incorporating or integrating a sort of flare or bulge in the liner, which produces positive locking with the front edge of the charge or positive locking in the charge.

To be sure, DE 1 812 462 A1 discloses a projectile with a fragmentation casing, which contains a high-explosive charge enclosed in foil, and this foil, which can consist of steel, copper, or plastic, has a number of elongated indentations that are arranged in rows extending in the longitudinal direction of the projectile. However, these indentations serve to form small hollow charges directed towards a cylindrical fragmentation casing, which surrounds the foil that encases the high-explosive charge. When the high-explosive substance is detonated, notches are cut into the fragmentation casing by the small hollow charges, and the casing is shattered into fragments along these notches. The size of the fragments corresponds to the distances between the indentations of a row and the distances between the rows. Use for fixing the foil relative to the high-explosive charge is not contemplated.

The flare can run peripherally around the foil. If the liner is inserted in the projectile casing in folded form, segmentation of the peripheral flare is possible. The resulting bulges also exhibit a very high degree of dimensional stability, and the spaces between them allow simple folding of the liner.

To increase the dimensional stability of the bulges, it is advisable to adjust the stiffness of the bulges in a systematic way, for example, by increasing the wall thickness/material thickness in the area of the bulges. Variation by means of the width and depth of the flare is also possible.

It has also proven advantageous to place several rows of flares or bulges in the liner.

The bulges or flares can be incorporated in the liner during its production by a simple modification of the liner tool.

The invention is explained in greater detail below on the basis of the specific embodiment of the invention illustrated in the drawings.

BRIEF DESCRIPTION OF THE DRAWING

FIG. 1 shows a partial view of a projectile with a liner that has been furnished with a flare.

FIG. 1*a* shows a slightly enlarged view of the flare from FIG. 1.

FIG. 2 shows a partial view of the projectile with a liner that has at least two flares.

DETAILED DESCRIPTION OF THE INVENTION

Figure 3:
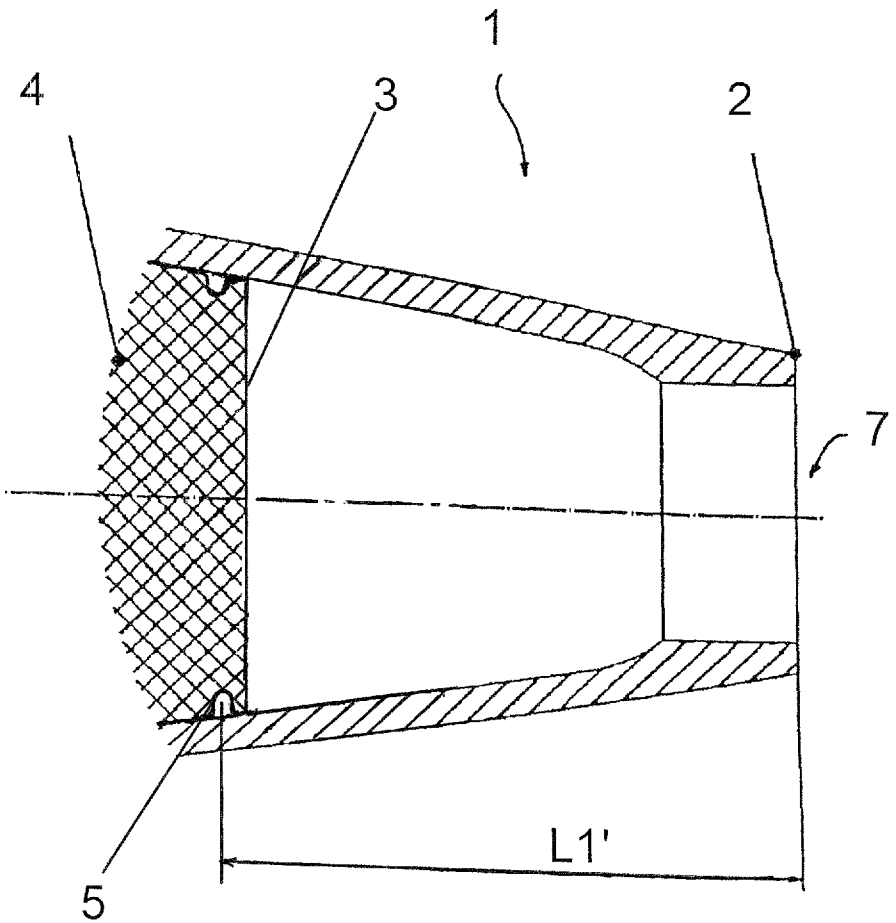
FIG. 3 shows a view as in FIG. 1, with the flare engaged in the explosive charge.

FIG. 1 shows a cutaway section of a projectile 1, which has a projectile casing 2 and a liner 3 located between the projectile casing and a high-explosive charge 4. To prevent the liner 3 from slipping on the high-explosive charge 4, the liner 3 is realized with an inwardly formed flare/bulge 5 at a well-defined point L1 relative to the surface of the charge 4 (first position L1 of the liner 3). The flare 5 is realized sufficiently stiff so that the liner 3 is positively locked on the front edge of the high-explosive charge 4 either immediately or after a few temperature cycles that displace the liner 3 relative to the charge 4 and the projectile casing 2 (second position L1' of the liner 3, FIG. 3), depending on the level of filling of the charge 4.

FIG. 2 shows the projectile 1 with more than one flare or bulge 5 (FIG. 2*a*) formed in it. The additional flare 6 is placed in the liner 3 at a well-defined length L2 relative to the surface of the high-explosive charge 4 and allows the liner 3 to interlock positively with the high-explosive charge 4 even at the time of casting and thus to be fixed from the start.

In principle, it may be assumed that here too, as is well known, the insensitive high-explosive charge is cast into the high-explosive artillery projectile 1. To prevent the high-explosive charge 4 from adhering to the inner wall of the projectile casing 2, the liner 3 is inserted. This liner 3 has the form of a plastic casing with rubber-like elastic properties. The liner 3 is inserted in the projectile casing 2 through a fuse hole 7. The insensitive high explosive charge 4 consists of a high explosive and a plastic binder system with other additives. This charge is cast into the liner 3, in which it then cures. The cured, formed high explosive thus forms the plastic-bound high-explosive charge 4. The high-explosive charge 4 has a coefficient of thermal expansion that is greater than that of the steel projectile casing 2 by a factor of 8-12.

The invention claimed is:

1. A liner made of plastic material and arrangeable between a casing of a projectile and a high-explosive charge to avoid contact between the high-explosive charge and the projectile casing, the liner comprising at least one integral flare or bulge that is inwardly formed so as to be interlockable with a front edge region of the high-explosive charge, the liner being displaceable between a first position in which the bulge or flare is spaced from the high-explosive charge and a second position in which the bulge interlocks with the front edge region of the high-explosive charge to prevent further displacement, wherein a material thickness of the liner increases in an area of the at least one flare or bulge.

* * * * *